US005530203A

United States Patent [19]

Adams et al.

[11] Patent Number: 5,530,203

[45] Date of Patent: Jun. 25, 1996

[54] COMPOSITE ELECTRICAL CONDUCTOR CABLE HAVING INTERNAL MAGNETIC FLUX SHIELD

[75] Inventors: Joseph W. Adams, Strongsville; Frederick S. Safran, Brecksville, both of Ohio

[73] Assignee: Rotor Tool Company, Cleveland, Ohio

[21] Appl. No.: 396,003

[22] Filed: Feb. 28, 1995

[51] Int. Cl.[6] ..... H01B 7/34; H01B 11/06

[52] U.S. Cl. ..... 174/36; 174/106 R; 174/115

[58] Field of Search ..... 174/36, 105 R, 174/106 R, 108, 109, 113 R, 107, 110 SY, 115

[56] References Cited

U.S. PATENT DOCUMENTS

| | | | |
|---|---|---|---|
| 2,180,731 | 11/1939 | Dickinson | 174/105 |
| 2,446,387 | 8/1948 | Peterson | 174/105 |
| 3,324,417 | 6/1967 | Garner | 333/1 X |
| 4,096,346 | 6/1978 | Stine et al. | 174/36 |
| 4,399,322 | 8/1983 | Hafner, Jr. | 174/101.5 |
| 4,408,822 | 10/1983 | Nikitas | 339/177 R |
| 4,443,658 | 4/1984 | Seguin | 174/113 C |
| 5,089,666 | 2/1992 | DiVila | 174/74 R |
| 5,235,132 | 8/1993 | Ainsworth et al. | 174/36 |
| 5,416,269 | 5/1995 | Kemp et al. | 174/36 |

*Primary Examiner*—Kristine L. Kincaid
*Assistant Examiner*—Chau Nguyen
*Attorney, Agent, or Firm*—Calfee Halter & Griswold

[57] ABSTRACT

A multiple conductor composite electrical cable has a braided steel shield about internally disposed power wires and multiple signal wires arranged radially external of the steel shield, whereby magnetic lines of flux from the power wires are contained within a center axial core of the composite cable defined by the steel shield to eliminate signal interference caused by coupling of magnetic flux with signal conducting wires disposed radially external of the power wires and steel shield.

12 Claims, 2 Drawing Sheets

COMPOSITE ELECTRICAL CONDUCTOR CABLE HAVING INTERNAL MAGNETIC FLUX SHIELD

FIELD OF THE INVENTION

The present invention pertains generally to electrical conductor cables and, in particular, to composite electrical conductor cables having power and signal conducting cables incorporated therein.

BACKGROUND OF THE INVENTION

Multiple conductor composite cables, such as the 9461-0013 cable manufactured by The Rotor Tool Company, Cleveland, Ohio, are widely used for transmission of power and control signals to, for example, automatic assembly tools such as nut runners, and connection to power monitoring and control devices such as the Rotor Tool Brushless DC Torque Angle Controller or other control devices such as disclosed in U.S. Pat. No. 5,117,919 incorporated herein by reference. Such cables are typically constructed by disposing a plurality of relatively small gauge control signal wires radially about center axially disposed relatively larger gauge power transmission cables, as generally shown in FIG. 1. In order to electrically insulate each of the individual cables, separate sheathings made of polyurethane or PVC are used, in addition to the individual sheathings of each cable, to bundle and insulate the cables in the desired arrangement.

A significant problem encountered with this approach when executed with insulative/non-metallic sheathings is that magnetic flux generated by the centrally disposed power cables propagates radially outward across the surrounding signal cables, causing interference in the control signals and consequent loss of accuracy of signals used to monitor and control a tool to which the cable is attached, as described in the '919 patent. In prior art cables, the use of tin/copper sheathings about the power cables does not block electrical interference from the outer signal wires.

SUMMARY OF THE INVENTION

The present invention overcomes these and other disadvantages of composite cables of the prior art by providing a steel magnetic flux shield about the axially disposed power transmission cables to prevent magnetic flux from coupling with control signals carried by control cables disposed radially about the power transmission cables.

In accordance with one aspect of the invention, there is provided a multiple conductor composite cable for carrying electrical and control signals which includes a plurality of power wires radially arranged about a cable axis and wrapped with a metallic coated material with a metallic surface of the material oriented to face radially inward toward the plurality of power wires, a shield including steel disposed radially about the plurality of power wires, a plurality of signal wires disposed radially about the power wires and the shield and parallel to the cable axis, pairs of the signal Wires wrapped together with metallic coated material with a metallic surface of the material oriented to face radially outward away from the signal wires, and a flexible coating encasing the signal wires.

These and other aspects of the invention will be apparent upon reading and understanding the following detailed description made with reference to the accompanying Figure.

BRIEF DESCRIPTION OF THE FIGURES

In the accompanying Figures

DETAILED DESCRIPTION OF A PREFERRED EMBODIMENT AND METHOD

Figure 1:
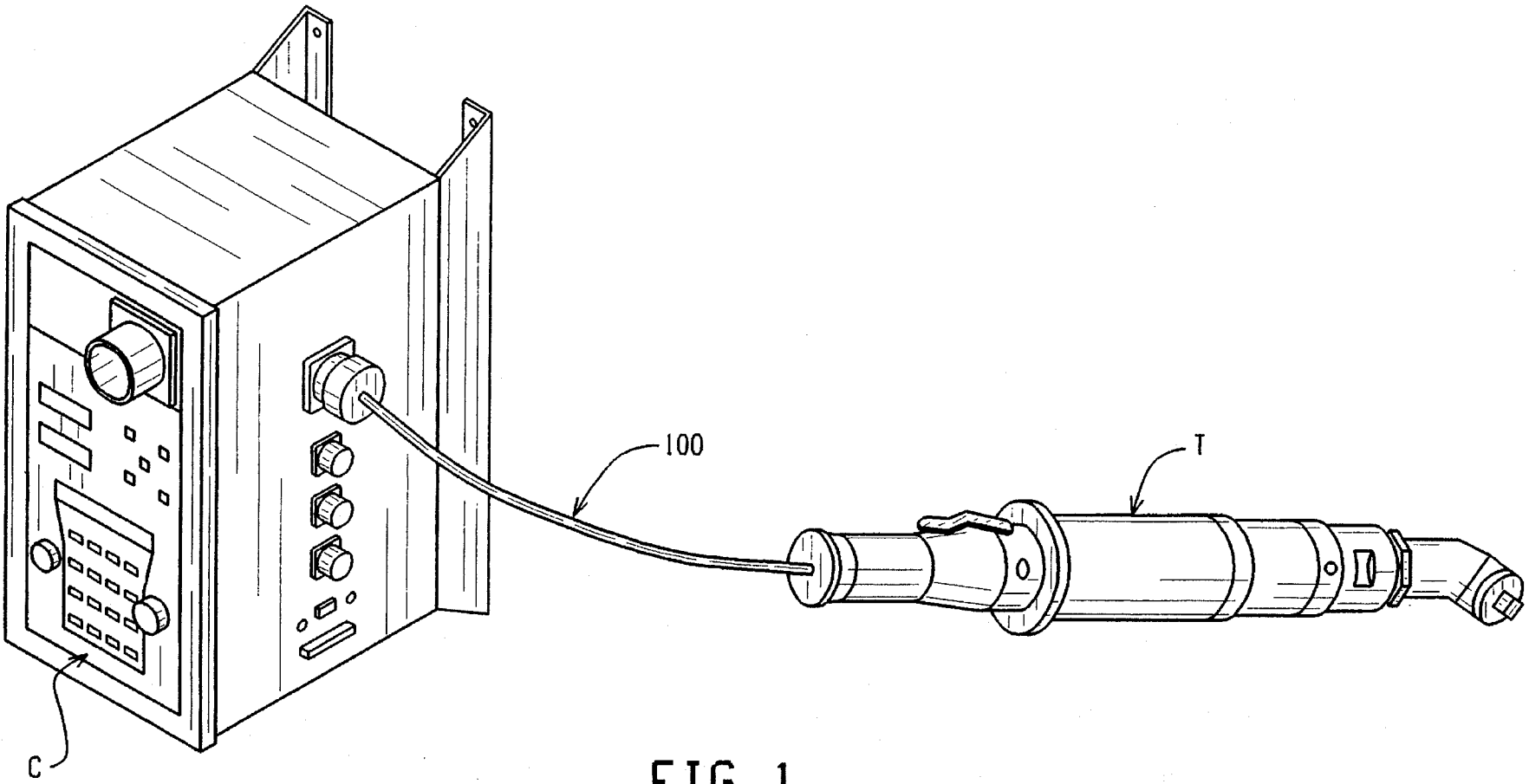
FIG. 1 is an arrangement diagram of a tool and torque controller connectable by the cable of the present invention.

As schematically illustrated in FIG. 1, an electric power tool T, such as a Rotor Tool nutrunner Model No. E130LRAAGV17 is connected by a composite cable 100 of the present invention, to a torque controller C, such as a Rotor Tool $R_{TEC}$, through which power is supplied to the tool and the reactive forces upon the driving end of the tool measured and monitored, and the tool drive motor controlled in response to such measurements. The cable of the present invention is adaptable for attachment to and use with other types of electric tools and tool torque monitoring and control devices such as Pro-Spec 6000 System, Beta Tech System and ITD System.

Figure 2:
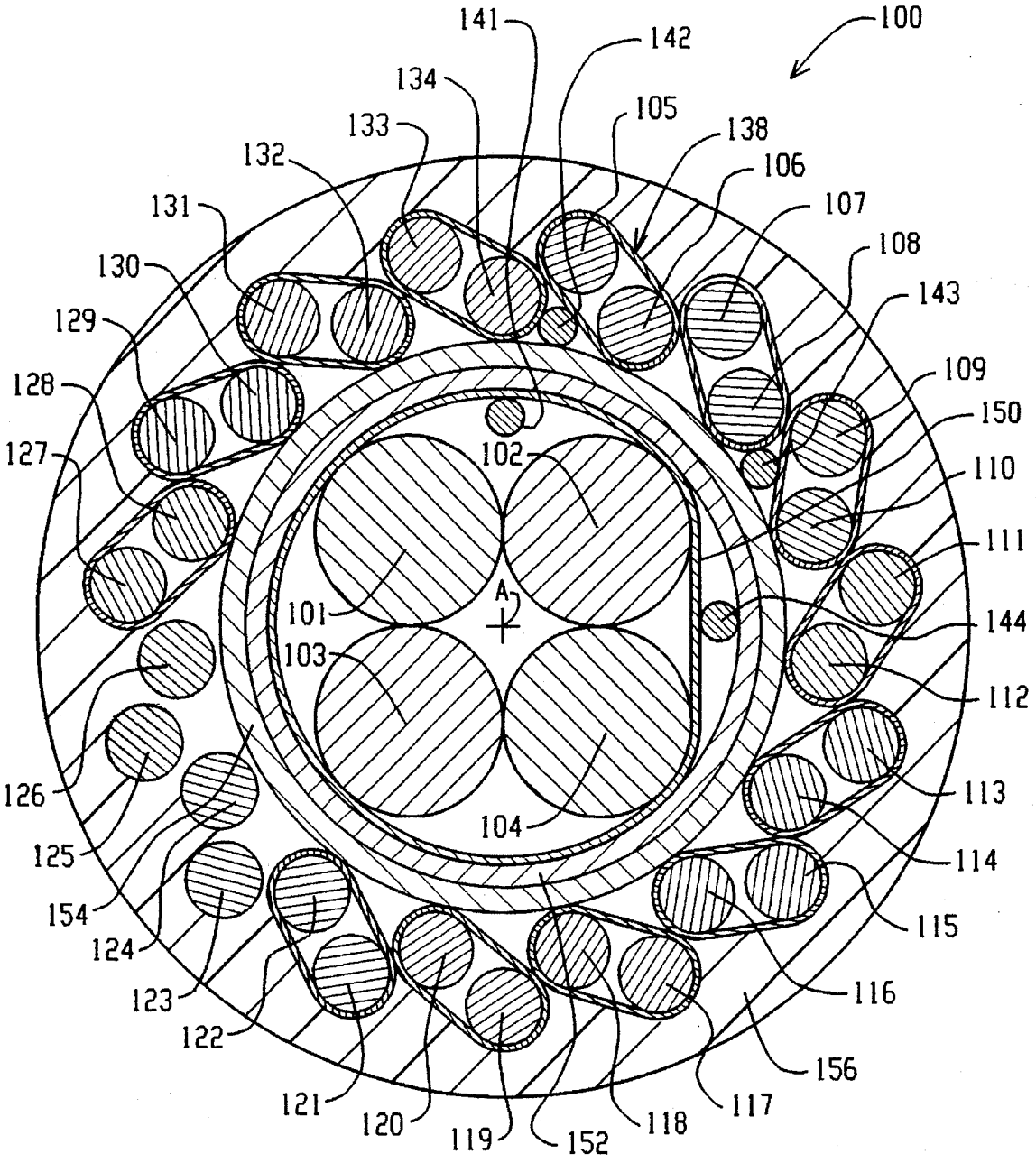
FIG. 2 is a cross-section of the composite cable of the present invention.

FIG. 2 illustrates a cross-section of one embodiment of the composite cable 100 of the present invention which includes, for example, four power transmission cables 101–104 disposed about a longitudinal axis A of the composite cable 100, thirty relatively smaller gauge control and/or signal cables 105–134 axially disposed about power cable 101–104, and four drain wires 141–144 for a total of 34 separate cables.

Power wires 101–104 may be, for example, 16 awg gauge. Each 16 awg wire is preferably made of a twisted bundle of twenty-six wires that are 30 awg solid wire in size. This bundle of wire is preferably coated (for example by extrusion) with an outer jacket of polyvinyl chloride (PVC) in various colors. A layer of nylon may be provided over the PVC layer as is known in the art. Alternatively, the wire bundles may be coated with Tefzel® 750.

Signal wires 105–134 may be preferably 24 awg gauge. Each 24 awg wire is preferably made of a twisted bundle of nineteen wires that are 36 awg solid wire in size. This bundle of wire is then coated with an outer jacket of polyvinyl chloride (PVC) in various colors to indicate pin connections. A total of twenty-six of the, 24 awg wires are twisted into thirteen pairs (e.g., wires 105 and 106, 107 and 108, etc.) and each pair wrapped in aluminum foil shielding tape 138 with the foil side facing radially outward away from the wires. The remaining four signal wires (123–126) are not wrapped in foil tape.

Drain wires 141–144 may preferably be uncoated 24 awg twisted bundles of nineteen wires 36 awg in size (such as 19/36 tinned), and selectively disposed within the composite cable as described below. The four power wires 101–104 are twisted together with one drain wire 141 and wrapped in an aluminum foil shielding tape 150 with the foil side facing radially inward toward the power wires. A second drain wire 144 is wrapped around the foil shielding tape 150 and a braided shield 152 of bare copper-clad steel, such as bare copper weld 8/36 or 9/37, is braided around the power wire cable bundle. The braid is made of bundles of eight wires of size 36 awg solid wire or in bundles of nine wires of size 37 awg solid wire. An outer jacket 154 of polyurethane is then extruded or wrapped around the power wire bundle.

The thirteen twisted pairs and four loose signal wires (123–126) are then wrapped around the power wire bundle, together with drain wires 142 and 143 which are preferably located closely proximate to, for example, transducer signal wire pairs 131 and 132, and 133 and 134, and encoder wire pairs 105 and 106, and 107 and 108, which are most critical to accurate instrumentation of the tool performance. An outer jacket 156 of, for example, polyurethane is then extruded over the entire cable bundle. As illustrated in FIG. 2, the outer jacket 156 preferably extends radially inward into gap areas g between adjacent signal wires to tightly grip the cable bundle and prevent relative movement of the wires to each other. The outer periphery of the signal wire bundle may be wrapped with polyurethane tape prior to extrusion of outer jacket 156 to prevent misalignment of the cable bundle during the extrusion process.

Although the invention has been shown and described with respect to a certain preferred embodiment and method, certain variations, modifications and equivalents may become apparent to those of ordinary skill in the art without departing from the scope of the present invention as defined by the accompanying claims.

What is claimed is:

1. A composite cable for carrying electrical power and control signals comprising a plurality of power wires radially arranged about a cable axis, said plurality of power wires wrapped with a metallic coated material with a metallic surface of said material oriented to face radially inward toward the plurality of power wires, a shield comprising steel disposed radially about said plurality of power wires, a plurality of signal wires disposed radially about said power wires and said shield and parallel to said cable axis, pairs of said signal wires wrapped with said metallic coated material with said metallic surface of said material oriented to face radially outward away from said signal wires, and a flexible casing about said signal wires.

2. The composite cable of claim 1 further comprising at least one drain wire combined with said power wires within said shield and at least one drain wire combined with said signal wires within said casing.

3. The composite cable of claim 1 further comprising a polyurethane sheath about said shield.

4. The composite cable of claim 1 wherein at least one of said signal wires is not paired with another of said signal wires.

5. The composite cable of claim 1 wherein said metallic coated material is aluminum foil shielding tape.

6. The composite cable of claim 1 wherein said shield is comprised of braided bare copper weld 8/36 or 9/37.

7. A method of making a composite electrical cable for attachment to a powered tool and a tool monitoring device, the cable having multiple power transmission wires and multiple signal and control wires selectively arranged and bundled together, the method comprising the steps of:

disposing at least two power transmission wires and a first drain wire generally parallel to a longitudinal axis of the cable, wrapping the power wires and first drain wire with a metallic coated material with a metallic layer of the material facing radially inward toward the wires, disposing a second drain wire adjacent and external to the metallic coated material wrapped about the wires, placing a shield comprising steel about the metallic coated material wrapped around the power wires, forming a sheath of polyurethane about the steel shield, disposing a plurality of signal wires and at least one drain wire radially about the sheath of polyurethane, with selected pairs of signal wires wrapped with said metallic coated material with said metallic layer of the material facing radially outward away from the signal wires and, forming an outer sheath of polyurethane about the external periphery of the plurality of signal wires.

8. The method of claim 7 further comprising the step of wrapping the plurality of signal wires with polyurethane tape prior to forming the outer sheath of polyurethane about the external periphery of the signal wires.

9. The method of claim 7 wherein the sheath of polyurethane about the steel shield is formed by extrusion.

10. The method of claim 7 wherein the outer sheath of polyurethane about the external periphery of the plurality of signal wires is formed by extrusion whereby the polyurethane extends into cavities between adjacent ones of said signal wires.

11. The method of claim 7 further comprising the step of placing said at least one drain wire proximate to signal wires carrying signals critical to obtain accurate measurement of tool performance by a monitoring device attached to a tool by the cable.

12. A composite electrical power and control cable adapted for attachment to an electrically powered and controlled tool, the composite cable comprising:

at least two power wires arranged about a cable axis and wrapped with a metallic material so that a metal surface of the metallic material is oriented to face radially inward toward the power wires;

a magnetic flux shield comprising a magnetic flux blocking material disposed radially about the power wires;

signal wires disposed radially about the shield; and, a flexible casing about the signal wires.

* * * * *